US007253829B2

(12) United States Patent
Gahang et al.

(10) Patent No.: US 7,253,829 B2
(45) Date of Patent: Aug. 7, 2007

(54) PRINTING APPARATUS AND METHOD HAVING FUNCTIONS TO COMPENSATE FOR LIGHT INTENSITY DIFFERENCE

(75) Inventors: Goo-soo Gahang, Yongin-si (KR); Jung-tag Gong, Suwon-si (KR); Sang-yun Shin, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 273 days.

(21) Appl. No.: 10/968,276

(22) Filed: Oct. 20, 2004

(65) Prior Publication Data

US 2005/0110863 A1 May 26, 2005

(30) Foreign Application Priority Data

Nov. 21, 2003 (KR) ..... 10-2003-0083032

(51) Int. Cl.
*B41J 2/47* (2006.01)

(52) U.S. Cl. ..... 347/252

(58) Field of Classification Search ..... 347/234–237, 347/240, 246–254; 358/1.5, 3.06
See application file for complete search history.

(56) References Cited

U.S. PATENT DOCUMENTS 4,885,594 A * 12/1989 Eguchi ..... 347/250
4,887,225 A * 12/1989 Yao ..... 358/1.5
5,489,936 A * 2/1996 Appel et al. ..... 347/248
2001/0028383 A1 10/2001 Mutou et al.
2002/0036688 A1 3/2002 Saito et al.
2002/0114012 A1* 8/2002 Fujita ..... 358/3.06

FOREIGN PATENT DOCUMENTS

| | | |
|---|---|---|
| JP | 07-032645 | 2/1995 |
| JP | 08-15631 | 1/1996 |
| JP | 08-160338 | 6/1996 |
| JP | 2000-52590 | 2/2000 |
| KR | 1020000067133 | 11/2000 |

* cited by examiner

*Primary Examiner*—Hai Pham
(74) *Attorney, Agent, or Firm*—Staas & Halsey LLP

(57) ABSTRACT

A print apparatus including a photoconductive drum, a laser scanning unit (LSU) to scan a surface of the photoconductive drum, and an image processing unit to generate and output dot size information corresponding to externally input image data. The dot size information determines sizes of individual dots on an image to be printed, a memory unit to store dot size compensation values related to a scanning distance of laser beams emitted from the LSU to the surface of the photoconductive drum to the LSU. The compensation values change the dot size information. The apparatus further includes a light intensity difference compensation unit to compensate for the dot size information according to the stored compensation values if the dot size information is received, and a pulse width modulation (PWM) unit to generate and output a pulse signal to control the scanning of the laser beams of the LSU according to the compensated dot size information.

13 Claims, 5 Drawing Sheets

PRINTING APPARATUS AND METHOD HAVING FUNCTIONS TO COMPENSATE FOR LIGHT INTENSITY DIFFERENCE

CROSS-REFERENCE TO RELATED APPLICATIONS

This application claims the benefit of Korean Patent Application No. 2003-83032 filed on Nov. 21, 2003, the disclosure of which is incorporated herein by reference.

BACKGROUND OF THE INVENTION

1. Field of the Invention

The present invention relates to a printing apparatus and a printing method. More particularly, the present invention relates to a laser printing apparatus and a printing method capable of compensating for influence due to light intensity differences occurring on the surface of a photosensitive drum.

2. Description of the Related Art

Due to the recent widespread use of computers, peripherals such as printers are increasing in use. Printers are input with text or graphics from computers and print the input information on sheets of paper. The printers may be classified into dot matrix printers, ink-jet printers, or laser printers. The dot matrix printers are low in price, but have the disadvantages of loud noise and poor print quality. The laser printers have good speed and print quality, but may have the disadvantage of high price. Therefore, in general, ink-jet printers have been mostly used by individuals.

However, recent developments in printer manufacturing technologies enable laser printers to be produced at a low price, and thus laser printers are gradually being more widely used. The laser printers print sheet by sheet using the electrophotographic method. The elements of laser printers can be mainly divided into a controller part and an engine part. The controller part interprets image data sent from a computer, stores the interpreted image data in a random access memory (RAM) of the printer itself, communicates with the engine part so that the engine part can prepare for print tasks, and sends the data stored in the RAM in a serial data format. The engine part includes an organic photoconductive drum, a laser scanning unit (LSU), a developer, a cleaning unit, a charging unit, a transfer unit, and a fuser unit. If data to be printed is received, the printer performs, for print tasks, the processes of cleaning, charging, laser scanning, writing, developing, transferring, and fusing.

The laser scanning unit forms a latent image on the photoconductive drum in the laser scanning stage. Specifically, if laser beams scan the photoconductive drum charged at the same voltage, photocurrents are generated on the scanned portions of the drum so that negative charges on the drum are eliminated. Accordingly, the drum has negatively charged portions and charge-free portions, and, through a next developing stage, negatively charged toner particles stick on the laser beam-scanned surface of the drum on which a latent image is formed, to thus form the characters and/or graphics.

FIG. 1 is a block diagram illustrating a structure of a conventional laser printing apparatus. Referring to FIG. 1, the printing apparatus includes an interface unit 10, an image processing unit 20, a Pulse Width Modulation (PWM) unit 30, an LSU interface unit 40, and an LSU 50. The interface unit 10, the image processing unit 20, the PWM unit 30, and the LSU interface unit 40 belong to the controller part, and the LSU 50 belongs to the engine part.

The interface unit 10 receives image data to be printed from an externally connected user terminal. The received image data is generally input in a binary data format.

The image processing unit 20 generates and outputs information on individual print spots, that is, dot sizes to be output on a sheet of paper based on the received image data. That is, a number of dots are gathered together to produce one image, and dot sizes must be properly adjusted at every print spot in order to output a clear image. Thus, the image processing unit 20 generates the information on the sizes of individual dots so as to properly adjust dot sizes. In general, the information on the dot sizes is divided into levels ranging from 0 (all white) to 255 (all black).

The PWM unit 30 generates and outputs a pulse signal having a different pulse width during every print period based on the information on the dot sizes. That is, if the dot size has the highest level of 255, the PWM unit 30 outputs a high pulse during one period, and, if the dot size has the middle level, outputs a high pulse during half of a period.

The LSU interface unit 40 communicates between the controller part and the LSU 50, and produces a control signal corresponding to a pulse signal generated from the PWM unit 30 to enable the LSU 50 to output proper laser beams. The laser beams of the LSU 50 scan the photoconductive drum according to the control signal to form a latent image.

The photoconductive drum is a core part of the laser printer, and is formed with a cylindrical aluminum tube on the surface of which organic photoconductive material is coated. If a latent image is formed on the photoconductive drum by the LSU 50, toner powder is stuck on latent image-forming portions so as to be transferred on a sheet of paper.

FIGS. 2A-2D are graphs illustrating data output from individual components in the printing apparatus of FIG. 1. FIG. 2(A) illustrates a periodic pulse signal, in which each period indicates a period during which one dot is printed.

FIG. 2(B) illustrates input image data which is received from the interface unit 10, in which the input image data is binary data having 1's and 0's.

FIG. 2(C) illustrates information on the sizes of dots calculated in the image processing unit 20. The size of a dot to be printed during every period shown in FIG. 2(A) is sequentially calculated and sent to the PWM unit 30.

FIG. 2(D) illustrates a pulse signal having pulse widths each adjusted according to the dot size information. For "255", the pulse value is maintained high during one entire period, for "128" (half of the above value), the pulse value is maintained high during half of a period, and for "64", the pulse value is maintained high during a quarter of a period.

If the pulse signal is converted to a control signal through the LSU interface unit 40, the LSU 50 accordingly outputs laser beams. The laser beams form a latent image on the surface of the photoconductive drum as described above.

The photoconductive drum is manufactured in a cylindrical shape, and the LSU 50 is spaced a certain distance from the center of the round surface of the cylinder, so that it is inevitable that the laser beams from the LSU 50 reach the center of the surface of the drum and the sides of the surface of the drum in different light intensities.

FIG. 3 is a graph illustrating such differences in light intensity. Referring to FIG. 3, light intensity of laser beams on the center of the drum surface has a maximum value of about 0.3 mW, and the light beams gradually decrease in intensity as the beams move toward the left and right sides of the surface. For example, the light intensity drops down to about 0.27 mW on the portions of the surface about 10 cm away from the center.

With the light intensity differences occurring, latent images may not be properly formed on the portions spaced from the center of the surface of the photoconductive drum, which can cause obscure writing on the left and right portions of the surface as compared to the central portion. Therefore, the image quality can be degraded.

SUMMARY OF THE INVENTION

Accordingly, it is an aspect of the present invention to solve the above and/or other drawbacks and problems associated with the conventional and/or other previous arrangements. It is another aspect of the present invention to provide a printing apparatus and a method capable of improving image quality by compensating for light intensity differences between the center and side portions of the surface of a photoconductive drum by using experimentally measured compensation values.

Additional aspects and/or advantages of the invention will be set forth in part in the description which follows and, in part, will be obvious from the description, or may be learned by practice of the invention.

The foregoing and/or other aspects and advantages may be achieved by providing a printing apparatus including a photoconductive drum, a laser scanning unit (LSU) to output laser beams to form an image on a surface of the photoconductive drum, an image processing unit to generate and output dot size information according to externally input image data, the dot size information determining sizes of individual dots to form a printed image from the latent image, a memory unit to store dot size compensation values in proportion to a scanning distance of the laser beams from the surface of the photoconductive drum to the LSU, a light intensity difference compensation unit to modify the dot size information using the stored compensation values, and a pulse width modulation (PWM) unit to generate and output a pulse signal to control the scanning of the laser beams according to the modified dot size information.

The printing apparatus may further include an interface unit to externally receive the image data, and an LSU interface unit to receive the pulse signal, convert the received pulse signal into a control signal to turn on and off the laser diode, and output the converted control signal to the LSU.

The compensation values stored in the memory unit are experimentally measured and recorded. The light intensity difference compensation unit multiplies the dot size information by the compensation values so that the compensated dot size information increases in proportion to a distance as the laser beams move toward edge sides of the photoconductive drum with respect to the center.

The foregoing and/or other aspects may also be achieved by providing a printing method for a print apparatus including a photoconductive drum and a laser scanning unit (LSU) to scan a surface of the photoconductive drum with laser beams to form a latent image, the method including receiving externally input image data, generating dot size information according to the received image data, wherein the dot size information determines sizes of individual dots forming an image to be printed, modifying the dot size information using dot size compensation values in proportion to a scanning distance of the laser beams from the surface of the photoconductive drum to the LSU, generating a pulse signal to control the scanning of the LSU by using the modified dot size information, and outputting the laser beams on the photoconductive drum according to the pulse signal with the LSU.

The modifying includes multiplying the dot size information by the compensation values so that the modified dot size information increases to be larger than original dot size information as the laser beams move toward edge sides of the photoconductive drum with respect to a center.

Accordingly, the present invention adjusts dot sizes according to a distance between the photoconductive drum and the LSU, to thereby minimize the influence caused by light intensity differences occurring on the surface of the photoconductive drum.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
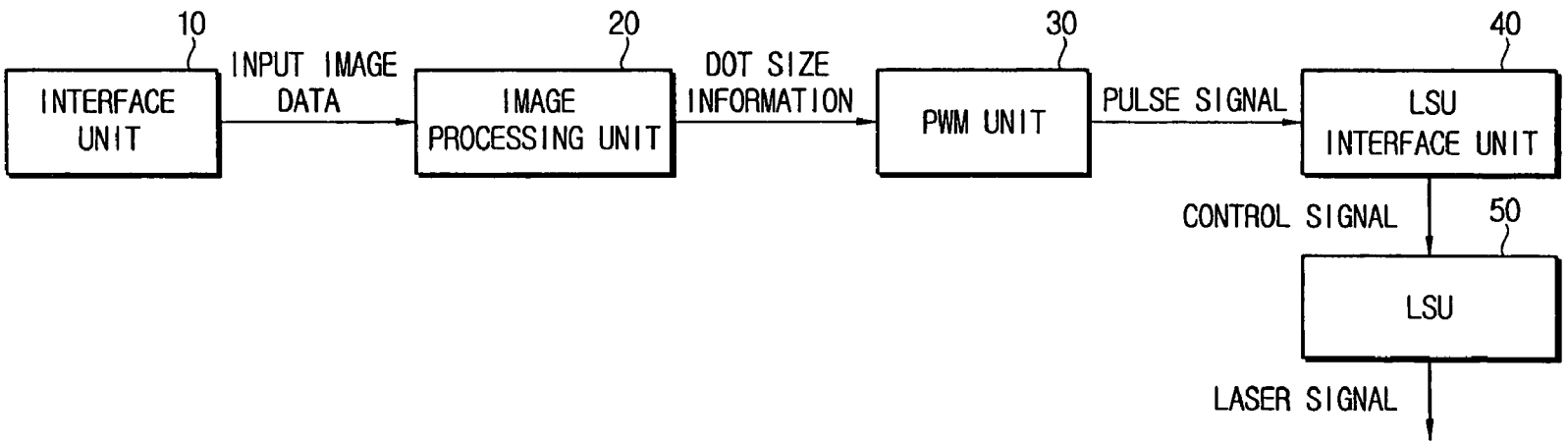
FIG. 1 (PRIOR ART)
FIG. 1 is a block diagram illustrating a structure of a conventional printing apparatus.
Figure 2:
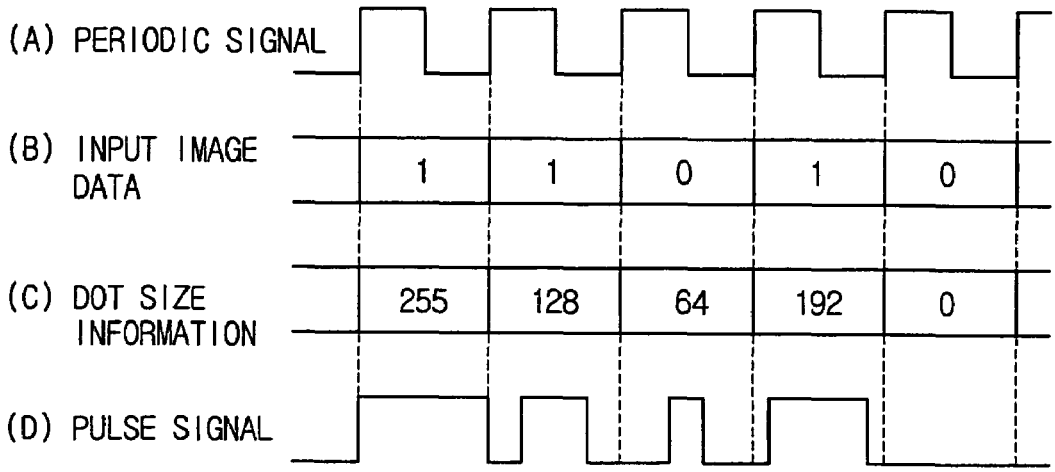
FIG. 2 (PRIOR ART)
FIGS. 2A-2D are graphs illustrating a process generating a pulse signal corresponding to input image data in the printing apparatus of FIG. 1.
Figure 3:
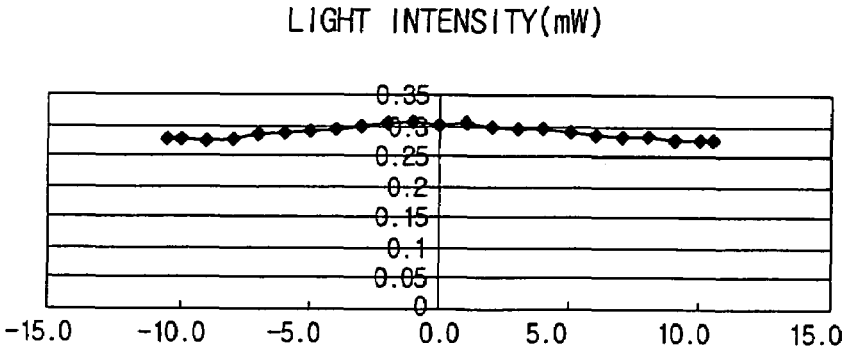
FIG. 3 (PRIOR ART)
FIG. 3 is a graph illustrating the relationship between a distance from the center of a photosensitive drum and light intensity.

Reference will now be made in detail to the embodiment of the present invention, an example of which is illustrated in the accompanying drawings, wherein like reference numerals refer to the like elements throughout. The embodiment is described below to explain the present invention by referring to the figures.

Figure 4:
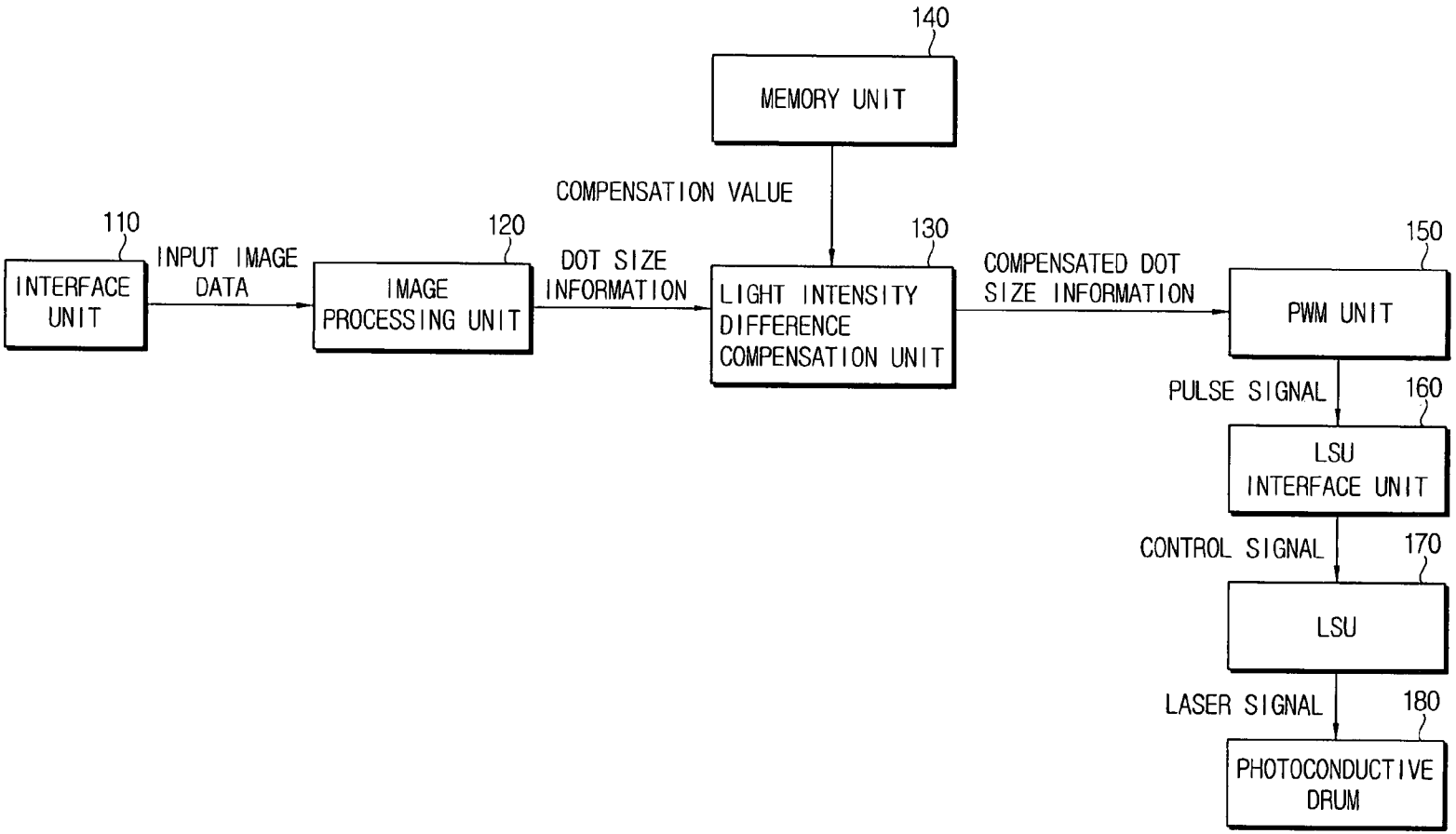
FIG. 4 is a block diagram illustrating a structure of a printing apparatus according to an embodiment of the present invention.

FIG. 4 is a block diagram illustrating a structure of a printing apparatus according to an embodiment of the present invention. As shown in FIG. 4, a controller part of the printing apparatus has an interface unit 110, an image processing unit 120, a light intensity difference compensation unit 130, a memory unit 140, a PWM unit 150, and an LSU interface unit 160. An engine part of the printing apparatus has a laser scanning unit (LSU) 170, a photoconductive drum 180, and other elements to print which are not shown.

The interface unit 110 is connected to external user terminals (not shown) for communication, receives data to be printed and a print command which are sent from the external user terminals. If a user inputs a print command to print a document prepared in his or her terminal, a printer driver installed in the terminal converts the document into data in a format that a corresponding printing apparatus can output for printing, and sends the data to the printing apparatus through the interface unit 110. The data of input images is generally expressed as binary data, that is, a digital signal.

The image processing unit 120 receives data of an input image, runs a predetermined algorithm, and generates information on dot sizes ranging from 0 to 255 levels. One completed image printed by a laser printer is constructed with a number of printed dots combined together. If the printed dots are the same in size, the overall combination of the dots can be unnatural, so the sizes of dots printed at individual spots are adjusted in diverse size levels in order to most naturally combine the dots for the entire image. The level of 0 indicates that no dot is printed on a spot, and the level of 255 indicates that the largest or the most color-saturated dot is printed on a spot. Accordingly, the resolution of the entire image can be enhanced.

In the related art, the surface of the photoconductive drum is scanned in different light intensities due to a distance difference between the LSU 170 and the photoconductive drum surface, which causes a light intensity difference on the surface of the photoconductive drum. Accordingly, relatively weak laser beams scan as the scanning is performed closer to the edges of the surface of the photoconductive drum, which may not remove a negative charge completely from the surface, degrading print quality since toner powder is not stuck on the surface properly. Thus, in order to compensate for the print quality degradation, information on dot sizes larger than those produced based on original image data is generated for the edge sides of the photoconductive drum. This increases the scanning time of the LSU 170 to prevent the image quality degradation due to the light intensity difference.

Certain compensation values are required to compensate for the dot size information, and the memory 140 stores the compensation values. The compensation values can be optimal values which are experimentally measured by printer developers. For example, as scanning is performed closer to the left and right sides from the center of the photoconductive drum, larger values can be used in proportion to a distance from the center of the photoconductive drum. On the other hand, the compensation values can vary depending on relative positions of the LSU 170 and the photoconductive drum. Also, the compensation values can vary when the optimal intensity of laser beams emitted from the LSU 170 is determined based on an average distance rather than being based on the center of the photoconductive drum. When based on an average distance, a portion having the optimal intensity becomes a reference, and the reference is set to a compensation value of 1. The portions having relatively large light intensity are set to compensation values smaller than a value of 1, and the portions having insufficient light intensity are set to compensation values larger than a value of 1.

The light intensity difference compensation unit 130 uses a compensation value database stored in the memory unit 140, and compensates for actual dot size information. The calculations for the compensations are performed through a predetermined equation, but, simply, the dot size information can be compensated for by multiplying a compensation value by an actual dot size level value. That is, the reference portion is set to the compensation value of 1 to remain unchanged, and the portions having insufficient light intensity are set to compensation values larger than 1 to compensate for the dot sizes.

The compensated dot size information is input to the PWM unit 150. The PWM unit 150 generates pulse width-modulated pulse signals to correspond to the compensated dot size information. Specifically, the PWM unit 150 modulates pulse widths so as to generate a pulse signal having a maximum pulse width for the level of 255, and generates a pulse signal having half of the maximum pulse width for the level of 128.

The LSU interface unit 160 enables the control part to recognize the LSU 170 of the engine part, and controls the laser diode of the LSU 170 to turn on and off according to the pulse signal output from the PWM unit 150 so as to output a control signal to control the LSU 170 to scan with laser beams. In more detail, the LSU interface unit 160 sets an effective interval for printing depending on a set paper size, and performs a masking process to ignore a pulse signal beyond the effective interval, to thereby convert the effective pulse signal into a control signal. The LSU 170 receives the control signal, and controls the inner laser diode to turn on and off, to thereby output laser beams.

FIGS. 5A-5F are graphs illustrating signals output from individual units of the print apparatus. That is, FIG. 5(A) illustrates periodic pulses indicating print periods. Each spot (or dot) is printed during one period.

FIG. 5(B) illustrates input image data externally received through the interface unit 110, and FIG. 5(C) illustrates dot size information output from the image processing unit 120 to convert the external input image data through a predetermined algorithm.

Since a problem caused by a light intensity difference occurs if the actual dot size information is used, the dot size information has to be properly compensated for by using the predetermined compensation values stored in the memory unit 140. FIG. 5(D) illustrates exemplary compensation values. In FIG. 5(D), diverse compensation values are illustrate d which are experimentally measured, and diverse values can be set depending on whether the light intensity on the surface of the photoconductive drum is excessive or insufficient. In general, the light source of the LSU 120 is spaced apart by a certain distance from the center of the cylindrical photoconductive drum, so that a value of 1 is set for the center of the surface of the photoconductive drum as a compensation value, and the compensation value gradually increases as laser beams move toward the left and right sides of the surface of the photoconductive drum, which compensates for the influence caused by insufficient light intensity.

Figure 5:
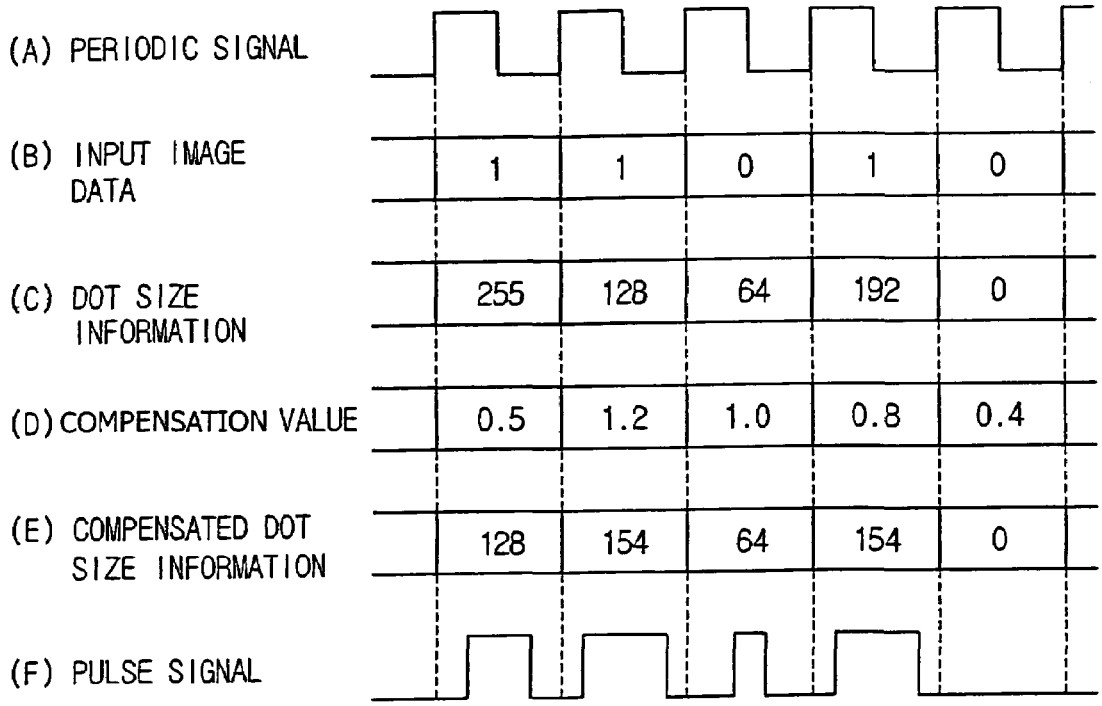
FIGS. 5A-5F are graphs illustrating a process of generating a pulse signal corresponding to input image data in the printing apparatus of FIG. 4.

FIG. 5(E) illustrates dot size information compensated for by the light intensity difference compensation unit 130 based on the compensation values shown in FIG. (D). As shown in FIGS. 5(C) and (D) of FIG. 5, the dot size information is compensated for by 128 if a compensation value of 0.5 is set for the level of 255, and the dot size information is compensated for by 154 if a compensation value of 1.2 is set for the level of 128. FIG. 5(E) illustrates that the compensations are performed through simple multiplication.

FIG. 5(F) is a graph illustrating an output pulse signal with pulse widths adjusted according to the compensated dot size information shown in FIG. 5(E). FIG. 5(F) illustrates that the pulse signal has a pulse width of half a period with respect to the level of 128 and that a pulse width is longer than the half period with respect to the level of 154. The control signal output from the LSU interface unit 160 is similar to the pulse signal shown in FIG. 5(F).

Figure 6:
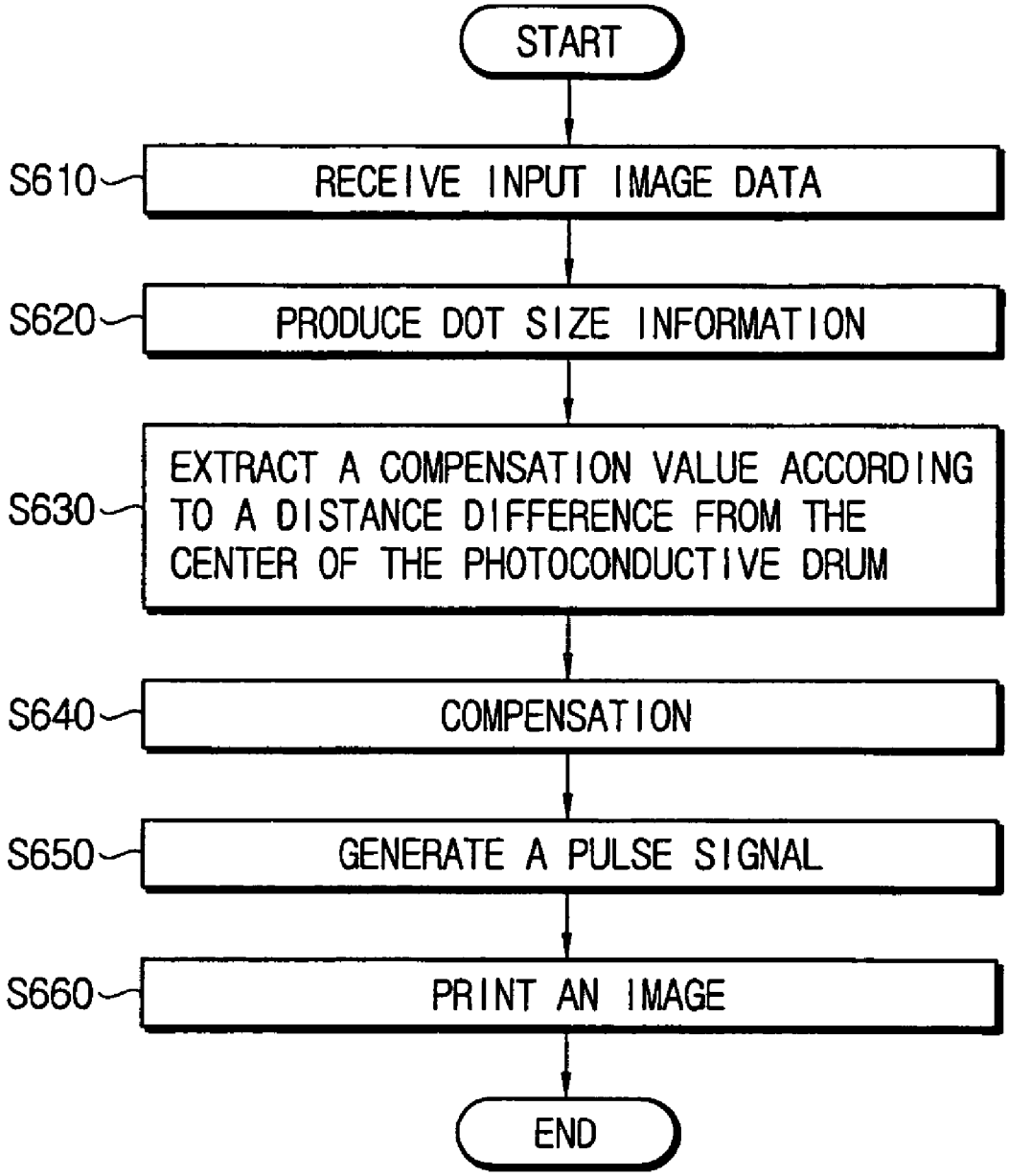
FIG. 6 is a flow chart illustrating a method of compensating for a light intensity difference occurring on the surface of the photosensitive drum in the printing apparatus of FIG. 4.

FIG. 6 is a flow chart illustrating a printing method for the printing apparatus according to an embodiment of the present invention. As shown in FIG. 6, if input image data is received from an external user terminal (not shown) at S610, the image processing unit 120 runs a predetermined algorithm and produces dot size information for enhanced resolution at S620.

The light intensity difference compensation unit 130 extracts a compensation value from the memory unit 140 at S630 and performs compensation based on the extracted value at S640. Next, the PWM unit 150 uses the compensated dot size information to produce a pulse signal at S650.

The pulse signal generated from the PWM unit 150 is input to the LSU 170 through the LSU interface unit 160, and, accordingly, the laser beams of the LSU 170 scan the photoconductive drum to form a latent image at S660. Next, the processes of developing, transferring, and fusing are sequentially performed so that the input image data is printed on a sheet of paper and the printed sheet is output.

As described above, since the light intensity difference occurring on the surface of the photoconductive drum is compensated for by using the dot size information, the edge sides of the output image can be relatively clearly printed.

According to the embodiment of the present invention, since experimentally measured compensation values are used to compensate for information on dot sizes, the dot size information is increased as to portions of insufficient light intensity, and decreased as to portions of excessive light intensity. As a result, the present invention solves the conventional problem that the edge sides of an object such as an image are unclearly printed, to thereby obtain the printed images of high quality.

Although an embodiment of the present invention has been shown and described, it would be appreciated by those skilled in the art that changes may be made in this embodiment without departing from the principles and spirit of the invention, the scope of which is defined in the claims and their equivalents.

What is claimed is:

1. A printing apparatus comprising:

a photoconductive drum;

a laser scanning unit (LSU) to scan a surface of the photoconductive drum with a laser to form a latent image;

an image processing unit to generate and output dot size information according to externally input image data, the dot size information determining sizes of individual dots to form a printed image from the latent image;

a memory unit to store dot size compensation values in proportion to a scanning distance of the laser beams from the surface of the photoconductive drum to the LSU;

a light intensity difference compensation unit to modify the dot size information using the stored compensation values; and a pulse width modulation (PWM) unit to generate and output a pulse signal to control the scan of the laser beams according to the modified dot size information.

2. The printing apparatus as claimed in claim 1, wherein the LSU comprises a laser diode, the printing apparatus further comprising:

an interface unit to receive the image data; and an LSU interface unit to receive the pulse signal, convert the received pulse signal into a control signal to turn on and off the laser diode and output the converted control signal to the LSU.

3. The printing apparatus as claimed in claim 2, wherein the light intensity difference compensation unit multiplies the dot size information by the compensation values so that the modified dot size increases as the laser beams move toward edge sides of the photoconductive drum with respect to a center thereof.

4. A printing method for a print apparatus including a photoconductive drum and a laser scanning unit (LSU) to scan a surface of the photoconductive drum with laser beams to form a latent image, comprising:

receiving externally input image data;

generating dot size information according to the received image data, wherein the dot size information determines sizes of individual dots forming an image to be printed;

modifying the dot size information using dot size compensation values in proportion to a scanning distance of the laser beams from the surface of the photoconductive drum to the LSU;

generating a pulse signal to control the scanning of the laser beams of the LSU using the modified dot size information; and outputting the laser beams on the photoconductive drum according to the pulse signal with the LSU.

5. The printing method as claimed in claim 4, wherein modifying comprises multiplying the dot size information by the compensation values so that the modified dot size increases as the laser beams move toward edge sides of the photoconductive drum with respect to a center thereof.

6. An apparatus comprising:

a photoconductive drum having a latent image comprising dots thereon;

a scanning unit to scan the photoconductive drum to thereby form the image;

a compensation unit to determine respective sizes of the dots based upon respective scanning distances between the photoconductive drum and the scanning; and a memory to store dot size compensation values in proportion to the scanning distances, wherein the compensation unit uses the dot size compensation values to determine the respective sizes of the dots.

7. The apparatus of claim 6, wherein the dot size compensation values are related to a distance of the respective dots from a center of the photoconductive drum.

8. The apparatus of claim 6, wherein the dot size compensation values are related to a position of the scanning unit relative to the photoconductive drum.

9. The apparatus of claim 6, wherein the dot size compensation values vary relative to a scanning distance of optimal intensity.

10. A method comprising:

receiving image information of an image comprising a plurality of dots;

determining respective sizes of the dots;

modifying the dot sizes proportional to a scanning distance between a scanning unit and a photosensitive medium; and scanning beams from the scanning unit to the photosensitive medium to form a latent image thereon comprised of dots having the modified dot sizes.

11. The method of claim 10, wherein the determining of the respective sizes of the dots comprises assigning respective dot size values between 0 and 255.

12. The method of claim 11, wherein the modifying of the respective dot sizes comprises multiplying the assigned respective dot size values by respective compensation values.

13. The method of clam 12, further comprising generating PWM signals based upon the multiplying of the assigned dot size values by the compensation values.

* * * * *

UNITED STATES PATENT AND TRADEMARK OFFICE

CERTIFICATE OF CORRECTION

PATENT NO. : 7,253,829 B2
APPLICATION NO. : 10/968276
DATED : August 7, 2007
INVENTOR(S) : Goo-soo Gahang et al.

It is certified that error appears in the above-identified patent and that said Letters Patent is hereby corrected as shown below:

Column 8, Line 29, change “scanning;” to --scanning unit;--.

Signed and Sealed this

Eighteenth Day of December, 2007

JON W. DUDAS
*Director of the United States Patent and Trademark Office*